United States Patent [19]

Kortmann et al.

[11] Patent Number: 5,028,236

[45] Date of Patent: Jul. 2, 1991

[54] TREATMENT OF POLYAMIDE FIBRES

[75] Inventors: Wilfried Kortmann, Nachrodt-Weibl; Wolf-Dieter Schröer, Munich; Karl-Heinz Passon, Leverkusen, all of Fed. Rep. of Germany

[73] Assignee: Bayer Aktiengesellschaft, Leverkusen, Fed. Rep. of Germany

[21] Appl. No.: 389,646

[22] Filed: Aug. 4, 1989

[30] Foreign Application Priority Data

Aug. 6, 1988 [DE] Fed. Rep. of Germany ..... 3826769

[51] Int. Cl.[5] ..... D06M 13/13; D06M 13/10

[52] U.S. Cl. ..... 8/128.1; 8/924; 8/115.6; 252/8.6

[58] Field of Search ..... 524/309; 252/8.6; 8/115.6, 128.1, 924

[56] References Cited

U.S. PATENT DOCUMENTS

| | | | |
|---|---|---|---|
| 2,171,241 | 8/1939 | Johnson | 530/353 |
| 2,482,578 | 9/1949 | Doggett et al. | 8/127.6 |
| 2,672,397 | 3/1954 | Lundgren et al. | 8/112 |
| 3,002,024 | 9/1961 | Blomquist | 8/127.6 |
| 4,350,788 | 9/1982 | Shimokawa | 524/309 |

FOREIGN PATENT DOCUMENTS 205583 12/1982 Japan .

58-87395 5/1983 Japan .

OTHER PUBLICATIONS

Faserforschung und Textiltechniek, vol. 22, No. 10, 1971, pp. 501-505; H. H. Ulrich: "Modifizierungsreaktionen an Polyämidfaden, Eine Literaturubersicht" *p. 501, Linke Col. No. 2, Ketene; p. 502, Rechte Col. No. 3: Umsetzung mit Ketenen-p. 503, No. 4*.

*Primary Examiner*—Paul Lieberman
*Assistant Examiner*—J. E. Darland
*Attorney, Agent, or Firm*—Sprung Horn Kramer & Woods

[57] ABSTRACT

Ketene dimers of the general formula (I)

wherein $R_1$ and $R_2$ independently of one another denote an alkyl or alkenyl radical each of which has at least 8 C atoms, a cycloalkyl radical having at least 6 C atoms or an aryl or aralkyl radical are used for the treatment of wool and synthetic polyamide fibres.

8 Claims, No Drawings

TREATMENT OF POLYAMIDE FIBRES

The present invention relates to a process for the treatment of wool and synthetic polyamide fibres with ketene dimers of the general formula

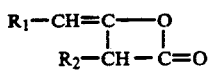

(I)

wherein $R_1$ and $R_2$ independently of one another denote an alkyl or alkenyl radical each of which has at least 8 C atoms, a cycloalkyl radical having at least 6 C atoms or an aryl or aralkyl radical.

In formula I aryl preferably represents phenyl or naphthyl and aralkyl preferably represents benzyl. The aromatic radicals can carry substituents, for example alkyl radicals having 1–12 C atoms.

Ketene dimers of the formula (I) wherein $R_1$ and $R_2$ represent alkyl or alkenyl radicals each of which has 10–22 C atoms are particularly suitable.

The preparation of the ketene dimers (I) is effected by known processes, for example by the elimination of hydrogen chloride from carboxylic acid chlorides in the presence of tertiary amines by the process of DE-A 2,335,488.

Examples of the ketene dimers (I) are octyl-, decyl-, dodecyl-, tetradecyl-, hexadec-yl-, octadecyl-, eicosyl-, docosyl-, tetracosyl- and cyclohexyl-ketene dimers and also dimers substituted by an aromatic hydrocarbon radical, for example phenyl-, benzyl- or β-naphthyl-ketene dimers, and also ketene dimers derived from montanic acid, naphthenic acid, naphthenic acid, Δ9,10-decylenic acid, Δ9,10-dodecylenic acid, palmitoleic acid, oleic acid, petroselinic acid, vaccenic acid, linoleic acid, linolenic acid, elaeostearic acid, parinaric acid, gadoleic acid, arachidonic acid and cetoleic acid and also from mixtures of fatty acids obtained from naturally occurring fats and oils, such as coconut oil, babassu oil, palm kernel oil, palm oil, olive oil, groundnut oil, rapeseed oil, beef tallow, lard and whale oil.

The ketene dimers (I) are preferably applied in the form of aqueous preparations thereof. In this regard, depending on the nature of (I), these preparations can be formulations of the liquid/liquid type or of the solid/liquid type, for both of which the term "emulsion" will be used here.

The aqueous emulsions are known. They preferably contain emulsification auxiliaries and, if appropriate, other cationic, nonionic or anionic surface-active substances and liquid hydrocarbons.

Emulsification auxiliaries are to be understood as meaning agents which are employed because of their protective colloid properties or for increasing the viscosity and hence the stability of the ketene dimer emulsions. Examples of suitable emulsification auxiliaries are cationic amino-modified starch (DE-A 1,148,130), polyvinyl alcohols (DE-A 2,306,542), polyvinyl lactams (DE-A 2,514,128) and carboxymethylcellulose (US-A 2,762,270).

Surface-active substances which can be used are cationic emulsifiers, such as N-octyldecylpyridinium chloride (US-A 3,046,186), nonionic emulsifiers which are obtained (DE-A 2,533,411) by the addition of ethylene oxide to hydroxyl groups and compounds containing fairly long hydrocarbon radicals, such as saturated and unsaturated alcohols having 12 to 18 carbon atoms or alkylated phenols, or anionic dispersing agents belonging to the group of sodium ligninsulphonates and aromatic naphtholsulphonic acid/formaldehyde condensates (DE-A 2,951,507).

The emulsions advantageously contain 0.5 to 30 per cent by weight, but preferably 1 to 15 per cent by weight, of ketene dimer (I), relative to the weight of the emulsion.

In general, the emulsification auxiliaries are employed in an amount of 0.2 to 15 per cent by weight, relative to the final emulsion. The amount employed is preferably 0.5 to 6 per cent by weight.

The amounts of surface-active substances are such that the emulsions obtained are stable for a prolonged period.

The proportions of alkylketene dimers, emulsification auxiliaries and surface-active substances should be so matched to one another in the individual case that usable, dilutable and pourable aqueous emulsions are obtained.

The stability of the aqueous emulsions can, if necessary, be increased considerably by adjusting the pH to 2.0 to 5.5, preferably 3.0 to 4.5, by means of mineral acids or $C_1$–$C_4$-carboxylic acids.

The emulsions can also contain other textile auxiliaries, such as soil-repellent, oil-repellent and water-repellent agents, fungicides, foaming agents or anti-foaming agents.

One way of producing the aqueous emulsions is a ketene dimer melt to which can be added about 5–30 per cent by weight liquid hydrocarbon as a solvent, for example toluene, cyclohexane, octane or a blend of hydrocarbons. The melt is stirred into a solution of the emulsification auxiliary at temperatures of between 40° C. and 90° C., homogenized with a homogenizer where necessary, and stirred as it cools.

It is also possible to stir a warmed solution of the emulsification auxiliary and where appropriate the surface-active substances into a ketene dimer melt. The emulsion obtained through phase inversion is then homogenized in a homogenizer.

The material to be treated can be wool or synthetic polyamides such as polymers of ε-caprolactam and polymers produced from dicarboxylic acid and diamines, e.g. from adipidic acid and hexamethylene diamine. The synthetic polyamides may also contain acid groups, for example sulphonic acid groups, enabling them to be dyed with cationic dyes.

The dyes normally used for dyeing fibres containing polyamide groups can be used, e.g. acid dyes, metal complex dyes such as 1:1 metal complex dyes, which may contain solubilizing groups such as sulphonic acid or carboxylic acid groups or sulphonamide or alkyl sulphonic radicals, or reactive dyes and cationic dyes, which are described for example in Ullmanns Encyclopädie der technischen Chemie, 3rd edition 1970, supplementary volume page 225.

The substrates can be in the form of flocks, tops, yarn or piece goods. The process is preferably used for the treatment of carpets. They can be in the form of woven, knitted and tufted goods. The aqueous emulsions are used with particular advantage for the treatment of velour and looped goods where the pile consists of wool or synthetic polyamides. The base material can consist, for example, of woven polypropylene fabrics or polyisopropylene or polyester nonwovens.

The process according to the invention ensures an optimum development of pile. This is to be understood as meaning that the pile opens and thus increases in volume and erects itself in the direction predetermined by the weaving, knitting and tufting pattern, and that the surface of the pile appears uniform without individual fibres projecting from the fibre structure. The substrate has a voluminous and agreeable handle.

The process can be carried out continuously and discontinuously. Continuous treatments by the dipping, padding, spraying and foam application methods are preferred.

In the continuous process the liquor ratio is especially 5-1:1. The heat treatment which is carried out subsequently to the liquor application is preferably carried out for 1-15 minutes at 100°-120° C., for example at steam temperatures of about 100° C.

The preferred conditions in the discontinuous exhaustion process are as follows: liquor ratio 40-10:1 treatment time 1-2 hours and temperature 65°-95° C.

The amount of the ketene dimers (I) to be used is preferably 0.01-5% by weight, particularly 0.05-1% by weight, relative to wool or synthetic polyamide.

The process according to the invention can be carried out at the same time as the dyeing or finishing with other agents, or after these processes.

The aqueous emulsions of ketene dimer are known from the publications mentioned above and have hitherto been used as a sizing agent for paper. It has now been found, surprisingly, that they impart advantageous properties to wool and synthetic polyamide materials.

EXAMPLE 1

Preparation of the ketene dimer from stearic acid 95.7 g of triethylamine and 475 g of toluene, previously dried by incipient distillation, are initially taken at room temperature. 250 g of stearoyl chloride are added dropwise with stirring, in the course of which the temperature rises to 50° C. and is kept by cooling at 50° C. After a further 2 hours at this temperature, 154 g of water warmed to 50° C. and containing 14 g of concentrated hydrochloric acid are added, and the mixture is stirred for a further 30 minutes. The organic phase is separated off at 50° C., and the solvent is removed by vacuum distillation at a bath temperature of 50-60° C. This gives 216 g (yield 98% of theory) of dimeric ketene of melting point 50-52° C.

EXAMPLE 2

Preparation of the ketene dimer from behenic acid 250 g of behenoyl chloride are reacted in 600 g of toluene and 80.7 g of triethylamine by the procedure according to Example 1. 120 g of water and 12 g of concentrated hydrochloric acid are added to the reaction mixture and stirring is continued for 30 minutes at 50° C. After the phases have been separated, the toluene is removed by vacuum distillation. The product, 213 g of ketene dimer (yield 94.8% of theory), has a melting point of 63-64° C.

EXAMPLE 3

Emulsification of the ketene dimer prepared in Example 1

A mixture of 100 g of Catol 110 (made by Roquett, cationic starch) and 1,500 g of water is stirred for 1 hour at 90°-95° C. 25 g of acetic acid and, as an anionic dispersing agent, 19.2 g of a phenol/bisulphite/urea/formaldehyde condensate are added to the solution, cooled to 70° C. A melt, warmed to 70° C, of 240 g of the ketene dimer of stearic acid and 48 g of white oil are run into the starch solution while the latter is stirred with an impeller, and the mixture is then homogenized for 2-3 minutes under a pressure of 40 bar and at 70° C. in a jet disperser. The product is diluted with 1,300 g of water and cooled to 30° C.

EXAMPLE 4

Emulsification of the ketene dimer prepared in Example 2

The ketene dimer of behenic acid is emulsified in the same manner.

| Mixture: | |
|---|---|
| 240 g | of behenic acid ketene dimer, |
| 100 g | of Cato 110 (made by Roquett, cationic starch), |
| 19.2 g | of the anionic dispersing agent of Example 3, |
| 48 g | of white oil, |
| 25 g | of acetic acid and |
| 2,800 g | of water. |

EXAMPLE 5

Emulsification of the ketene dimer of stearic acid prepared in Example 1, using Moviol 8-88 (made by Hoechst, polyvinyl alcohol) as the emulsification auxiliary.

The emulsification process corresponds to that described in Example 3.

| Mixture: | |
|---|---|
| 240 g | of stearic acid ketene dimer, |
| 150 g | of Moviol 8-88 (made by Hoechst, polyvinyl alcohol), |
| 19.2 g | of the anionic dispersing agent of Example 3, |
| 48 g | of white oil, |
| 25 g | of glacial acetic acid and |
| 2,800 g | of water. |

EXAMPLE 6

Emulsification of the ketene dimer of behenic acid prepared in Example 2, using Moviol 8-88 (made by Hoechst, polyvinyl alcohol) as the emulsification auxiliary.

The emulsification is carried out as described in

EXAMPLE 3

| Mixture: | |
|---|---|
| 240 g | of behenic acid ketene dimer, |
| 150 g | of Moviol 8-88 (made by Hoechst, polyvinyl alcohol), |
| 19.2 g | of the anionic dispersing agent of Example 3, |
| 48 g | of white oil, |
| 25 g | of glacial acetic acid and |
| 2,800 g | of water. |

USE EXAMPLES

EXAMPLE 7

Velour carpeting manufactured on a tufting machine and having a nylon 6,6 pile and a pile weight of 530 g/m$^2$ is dyed on a continuous carpet range. The range comprises 1. dye applicator,
2. steamer,
3. 3 suitably linked washing compartments,
4. suction device and
5. stenter frame as a drying device.

The treatment liquor contains, per liter:

| | A | B |
|---|---|---|
| Yellow acid dyestuff of DE-B 2,708,188, Example 2 | 0.4 | 0.4 |
| C.I. Acid Red 150 (No. 24,800) | 0.25 | 0.25 |
| Blue acid dyestuff of DE-B 2,640,602, Example 1 | 0.23 | 0.23 |
| Padding auxiliary of the formula | 1.5 | 1.5 |

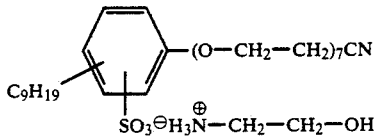

| | | |
|---|---|---|
| Wetting auxiliary of the formula | 0.3 | 0.3 |

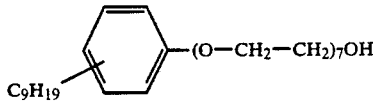

| | | |
|---|---|---|
| Disodium phosphate | 0.2 | 0.2 |
| Acetic acid | 6.8 | 6.8 |
| Preparation according to Example 3 | — | 7.5 |

The speed of the carpeting is 12 m/minute. The liquor pick-up is 270% by weight of the weight of the pile. The steaming time is 3 minutes. After it has passed through the washing compartments the substrate is freed from water and dried at 110° C. The goods treated with formulation A exhibit a depressed, flat velour portion, a harsh handle and a straw-like character. On the other hand, the goods treated with formulation B exhibit an almost vertical velour which has a good orientation, corresponding to the tufting adjustment. The upper side of the velour is uniform and with almost no projecting fibres. The handle has a voluminous character.

EXAMPLE 8

A tufted carpet having a pile weight of 450 g/m$^2$ is employed for continuous dyeing. The pile material consists of 3 differently modified polyamide fibres:

| | | |
|---|---|---|
| Low-dyeable | = | fibre which can be faintly dyed with an acid-dyestuff |
| Deep-dyeable | = | fibre which can be deeply dyed with acid dyestuffs |
| Basic-dyeable | = | fibre which can be dyed with cationic dyestuffs. |

The dyestuffs are so chosen that the differences in shade between the types of fibre are not shifted.

The treatment liquor contains, per liter:

| | A | B |
|---|---|---|
| Yellow acid dyestuff of DE-B 2,708,188, Example 2 | 0.59 | 0.59 |
| Red acid dyestuff of DE-B 2,712,170, Example 1 | 0.15 | 0.15 |
| C.I. Acid Blue (= No. 62,070) | 0.4 | 0.4 |
| Yellow cationic dyestuff of DE-A 2,130,790, Example 1 | 0.04 | 0.04 |
| Red cationic dyestuff of DE-B 1,011,396, Example 48 | 0.002 | 0.002 |
| Blue cationic dyestuff of BE-A 706,104, Example 12, 3rd dyestuff | 0.06 | 0.06 |
| Padding auxiliary as in Example 7 | 1.5 | 1.5 |
| Dispersing agent of the formula $C_{17}H_{33}—CH_2—(O—CH_2—CH_2—)OH_{45-50}$ | 0.5 | 0.5 |
| Thickener based on locust bean flour ether | 3.0 | 3.0 |
| Acetic acid (60% strength) | 5.5 | 5.5 |
| Preparation according to Example 4 | — | 7.5 |

The liquor is applied at 500% by weight of the pile weight and treatment is as described under 7. The shade differentiation of formulations A and B is the same. The resulting quality is as described in Example 7.

EXAMPLE 9

Carpeting having a pile of nylon 6,6 and a pile weight of 580 g/m$^2$ is dyed by the method of Example 7 using formulation A described therein. After it has been dried and shaved, a soil-repellent, oil-repellent and water-repellent finish is applied to the carpet on a foam applicator.

The finishing liquor used is an aqueous liquor containing, per liter:

| | A | B |
|---|---|---|
| Finishing agent | 12.5 | 12.5 |
| Foaming agent | 3.0 | 3.0 |
| Preparation according to Example 3 | — | 5.0 |

The finishing agent is a polymer consisting of 35% by weight of units of the formula

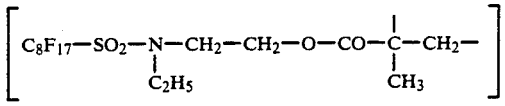

and 65% by weight of units of the formula

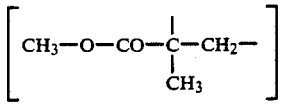

The foaming agent employed is the amine oxide of an alkyl ether of tri-(hydroxyethyl)-amine. The liquor is foamed by means of a static foam mixer to a foam weight of 25 g per liter and is pressed onto the carpet pile until the increase in wet weight is 20%. After being dried and treated at 150° C. for 15 minutes in a stenter frame, the goods are assessed after being stored for 6 hours. The pile of the goods finished with liquor A is harsh, cracked and flat and is typical of the rough handling and lack of development of the pile on a continuous dyeing machine. Finishing with liquor B gives a full, voluminous and soft textile character with an almost vertical pile.

EXAMPLE 10

A carpet of wool velour having a fibre covering of 950 g/m$^2$ is used for the treatment.

The wool had been washed in the form of loose fibre and slightly bleached. After being spun into yarn, tufted to form a carpet and having a backing applied, the goods are treated, without previous wet treatment, by the process described in Example 9.

The finishing liquor contains, per liter:

| | | |
|---|---|---|
| Foaming agent of Example 9 | 3 | g |
| Preparation according to Example 3 | 10 | g |
| Weight of foam per liter: | 40 | g |
| Increase in wet weight: | 20% | of the weight of the goods |
| Drying: | 100% | on a stenter frame. |

Assessment of the goods gives the following result:

The goods which have been treated with the finishing liquor exhibit a markedly denser pile surface than the untreated goods. The handle is also more voluminous and softer.

EXAMPLE 11

A carpet is treated with a preparation according to Example 5 by the procedure according to Example 10.

The finishing liquor used is an aqueous liquor containing, per liter:

| | | |
|---|---|---|
| Foaming agent of Example 9 | 3 | g |
| Preparation according to Example 5 | 10 | g |
| Weight of foam per liter: | 40 | g |
| Increase in wet weight: | 20% | of the weight of the goods |
| Drying: | 100% | on a stenter frame. |

Assessment of the goods gives the following result:

The goods which have been treated with the finishing liquor exhibit a markedly denser pile surface than the untreated goods. The handle is also more voluminous and softer.

EXAMPLE 12

A carpet is treated with a preparation according to Example 6 by the process described in Example 10.

The finishing liquor contains, per liter:

| | | |
|---|---|---|
| Foaming agent of Example 9 | 3 | g |
| Preparation according to Example 6 | 10 | g |
| Weight of foam per liter: | 40 | g |
| Increase in wet weight: | 20% | of the weight of the goods |
| Drying: | 100% | on a stenter frame. |

Assessment of the goods gives the following result:

The quality corresponds to that described in Example 11.

What is claimed is:

1. Process for the treatment of wool and synthetic polyamide fibres, characterized in that ketene dimers of the general formula

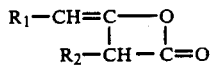

(I)

wherein $R_1$ and $R_2$ independently of one another denote an alkyl or alkenyl radical each of which has at least 8 C atoms, a cycloalkyl radical having at least 6 C atoms or an aryl or aralkyl radical, are used.

2. Process according to claim 1, characterized in that ketene dimers of the formula (I) wherein $R_1$ and $R_2$ represent alkyl or alkenyl radicals each of which has 10–22 C atoms, are used.

3. Process according to claim 1, characterized in that the ketene dimers are used in the form of aqueous emulsions.

4. Process according to claim 1, characterized in that aqueous emulsions containing 0.5–30% by weight of a ketene dimer (I) and 0.2–15% by weight of an emulsification auxiliary are used.

5. Process according to claim 1, characterized in that the ketene dimers are employed in a proportion of 0.05–1% by weight, relative to the fibre.

6. Process according to claim 1, characterized in that it is carried out continuously.

7. Process according to claim 1, characterized in that the wool and synthetic polyamide fibres are present in the form of carpet materials.

8. Wool and synthetic polyamide materials which have been treated by the process of claim 1.

* * * * *